US006435084B1

(12) United States Patent
Suzuki

(10) Patent No.: US 6,435,084 B1
(45) Date of Patent: Aug. 20, 2002

(54) ROTARY TYPE STENCIL PRINTING MACHINE

(75) Inventor: Atsushi Suzuki, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 2 days.

(21) Appl. No.: 09/716,409

(22) Filed: Nov. 21, 2000

(30) Foreign Application Priority Data

Nov. 26, 1999 (JP) ..... 11-336339
Oct. 13, 2000 (JP) ..... 2000-313820

(51) Int. Cl.[7] ..... B41L 13/04
(52) U.S. Cl. ..... 101/118; 271/273
(58) Field of Search ..... 101/116, 117, 101/118, 410; 400/636.1; 271/273, 274

(56) References Cited

U.S. PATENT DOCUMENTS 5,419,243 A * 5/1995 Hanzawa et al. ..... 101/118
5,483,878 A * 1/1996 Hanzawa ..... 101/118
6,026,744 A * 2/2000 Miyata ..... 101/118
6,234,076 B1 * 5/2001 Mizutani et al. ..... 101/118

FOREIGN PATENT DOCUMENTS

EP 0 888 896 1/1999

* cited by examiner

*Primary Examiner*—Stephen R. Funk
(74) *Attorney, Agent, or Firm*—Kanesaka & Takeuchi

(57) ABSTRACT

To adjust positions of pinch rollers without rotating a press drum, in a nonprinting state, the pinch rollers are lifted to upper positions at which the pinch rollers are not brought into contact with the press drum by pivoting arms and cams, and the pinch rollers are moved along a shaft in conformity with width of a print sheet to thereby adjust a clearance therebetween. In starting a printing operation, since the pinch rollers are not brought into contact with the press drum and the width can immediately be adjusted, it is not necessary to move a recess portion of the press drum to location of the pinch rollers by rotating the press drum, therefore a first print time is shortened.

6 Claims, 16 Drawing Sheets

FIG. 15 Prior Art

ROTARY TYPE STENCIL PRINTING MACHINE

BACKGROUND OF THE INVENTION

1. Field of the Invention

The present invention relates to a rotary type stencil printing machine. According to the rotary type stencil printing machine of the present invention, a print sheet is printed while being carried by being sandwiched between a printing drum and a back press roller. Further, the print sheet is carried while being pressed to the back press roller by a pinch roller after having been peeled off from the printing drum.

2. Description of the Related Art

FIG. 15 is a sectional view showing an example of a basic structure of a conventional rotary type stencil printing machine.

The stencil printing machine is provided with a printing drum 100. The printing drum 100 is provided with a base member 103 comprising a pair of circular plate members 101 arranged coaxially on a common central axis line 104 and a stencil clamping base 102 for connecting the pair of circular plate members 101. The base member 103 is fixed with a gear, not illustrated, coaxially with the central axis line 104. The gear is in mesh with a drive gear, not illustrated. By rotation of the drive gear, the base member 103 is driven to rotate centering on the central axis line 104.

A screen member 105 which is ink-permeable and flexible, is made to wrap on the base member 103. One end portion of the screen member 105 is fixed to the stencil clamping base 102 of the base member 103. The screen member 105 is made to wrap on outer peripheral surfaces of the circular plate members 101. Other end portion of the screen member 105 is elastically attached to the stencil clamping base 102 via a spring, not illustrated. Therefore, the screen member 105 is elastically deformed outwardly when depressed from an inner side thereof. The stencil clamping base 102 is provided with clamping means 107. Perforated stencil sheet 106 is fixed to the stencil clamping base 102 at a front side thereof by the clamping means 107 and is made to wrap on an outer circumferential surface of the screen member 105.

At an inner portion of the printing drum 100, a squeegee roller 110 is vertically movably provided. The squeegee roller 110 is lifted and lowered at a predetermined timing in synchronism with rotation of the printing drum 100 and presses the screen member 105 outwardly. Ink supplying means, not illustrated, supplies a constant amount of ink onto a peripheral face of the squeegee roller 110.

On a lower side of the printing drum 100, a press drum 200 which is a back press roller is arranged. A diameter of the press drum 200 is substantially the same as that of the printing drum 100. A rotational axis line 201 of the press drum 200 and the central axis line 104 of the printing drum 100 are in parallel with each other. In a nonprinting state, a very small clearance is provided between the printing drum 100 and the press drum 200. The press drum 200 is driven to rotate in a direction reverse to that of the printing drum 100 in synchronism with rotation of the printing drum 100.

A recess portion 202 is formed at an outer circumferential surface of the press drum 200. When the printing drum 100 and the press drum 200 are rotated in synchronism with each other, the recess portion 202 corresponds to the clamping means 107 of the printing drum 100. Therefore, even when a clearance between the printing drum 100 and the press drum 200 is very small, the clamping means 107 does not collide with the press drum 200.

A clamp 203 is provided at proximity of the recess portion 202 of the press drum 200. The clamp 203 holds a front end of print sheet supplied between the printing drum 100 and the press drum 200. The print sheet is held by the clamp 203, thereafter, sandwiched between the press drum 200 and printing drum 100 in accordance with rotation of the press drum 200 and is fed forwardly.

At proximity of the press drum 200, a pinch roller 300 is rotatably provided. The pinch roller 300 is arranged side by side on a sheet discharge side of the press drum 200. The pinch roller 300 presses the print sheet immediately after having been printed to the press drum 200 and peels off the print sheet from the printing drum 100. Two pieces of the pinch rollers 300 are brought into contact with two edge portions in the width direction of the print sheet. A clearance between the two pieces of pinch rollers 300 in the axial direction can be adjusted in accordance with a width of the print sheet.

The print sheet is supplied between the printing drum 100 and the press drum 200. The squeegee roller 110 is lowered and presses the screen member 105 outwardly at the predetermined timing. The screen member 105 and stencil sheet 106 which are deformed outwardly, sandwich the print sheet between the press drum 200 and the screen member 105 and stencil sheet 106. The print sheet is carried while being sandwiched between the deformed printing drum 100 and the press drum 200. While the print sheet is being carried, ink supplied to an inner circumferential face of the screen member 105, passes through the screen member 105 and stencil sheet 106, is transcribed onto the print sheet and forms an image.

When the stencil printing machine is brought into a standby state, the printing drum 100 and the press drum 200 are brought into a positional relationship shown by FIG. 15. That is, the clamping means 107 of the printing drum 100 and the recess portion 202 of the press drum 200 coincide with each other. Therefore, the pinch roller 300 is brought into contact with the outer circumferential surface of the press drum 200. Under the state, the two pieces of pinch rollers 300 can not be moved in the axial direction in accordance with the width of the print sheet. In order to move the pinch rollers 300 in the axial direction, it is necessary to rotate the press drum 200 to a pinch roller moving position shown in FIG. 16 and coincide the recess portion 202 of the press drum 200 with the pinch rollers 300 to thereby enable to move the pinch rollers 300 without resistance.

As has been explained above, according to the conventional stencil printing machine, a time period for moving the press drum 200 is needed for adjusting positions of the pinch rollers 300. The time period for moving the press drum 200 is added to first print time and start up time for printing. The first print time indicates a time period from when a print button is depressed until a sheet of printed matter is discharged. It is generally recognized that the shorter the time period the higher the function of the printing machine and shortening of the first print time has been desired.

SUMMARY OF THE INVENTION

It is an object of the present invention to provide a rotary type stencil printing machine having short first print time since positions of pinch rollers can be adjusted without rotating a press drum.

According to a first aspect of the present invention, there is provided a rotary type stencil printing machine comprising a printing drum (2) on which a perforated stencil sheet is made to wrap and which is rotated, a press drum (10) arranged at a vicinity of the printing drum and rotated in a direction reverse to a direction of the printing drum, pinch rollers (15) rotatably provided at a vicinity of the press drum for pressing a print sheet to the press drum such that the print sheet, which has been sandwiched between the printing drum and the press drum and printed, is held and carried by the press drum, pinch roller position adjusting means for adjusting positions of the pinch rollers in an axis line direction such that the pinch rollers can be brought into contact with predetermined positions of the print sheet, pinch roller releasing means for moving the pinch rollers between pinch positions at which the pinch rollers are brought into contact with the press drum and release positions at which the pinch rollers are separated from the press drum and controlling means (40) for controlling the pinch roller position adjusting means and the pinch roller releasing means such that the positions of the pinch rollers in the axis line direction can be adjusted only when the pinch rollers are set to the positions separated from the press drum.

According to a second aspect of the present invention, there is provided the rotary type stencil printing machine according to the first aspect, further comprising a sheet width sensor (17) for detecting a width of the supplied print sheet, wherein the pinch rollers (15) are two pieces of pinch rollers for pressing two edge portions of the print sheet in a width direction to the press drum, the pinch roller position adjusting means comprising a pair of moving members (20) made movable in the width direction of the print sheet and attached with the pinch rollers, moving means (belt 23) for moving the pair of moving members in directions reverse to each other and a movement detecting sensor (movement sensor 26) for detecting positions of the moving members, the pinch roller releasing means comprising attaching means (arms 30) for attaching the pinch rollers pivotably to the moving members, driving means (release motor 35) for setting the pinch rollers to the release positions or the pinch positions by pivotably moving the pinch rollers relative to the moving members and a release detecting sensor (release sensor 37) for detecting whether the pinch rollers are brought into a release state and the controlling means (40) sets the pinch rollers to the release positions by operating the driving means of the pinch roller releasing means after finishing a printing operation and controls the pinch roller position adjusting means in accordance with a signal from the sheet width sensor before carrying out the printing operation.

According to a third aspect of the present invention, there is provided the rotary type stencil printing machine according to the second aspect, wherein the pinch roller releasing means further comprises cams (release cams 36), which are connected to the driving means and pivoting, and an operating plate (32), which is provided to be brought into contact with the cams and pivoted by pivoting the cams and one end portion of which is engaged with the attaching means, and the pinch rollers are moved by the driving means, the cams, the operating plate and the attaching means.

According to a fourth aspect of the present invention, there is provided the rotary type stencil printing machine according to the second aspect, wherein the pinch roller releasing means further comprises cams (release cams 36), which are connected to the driving means and pivoting, an operating plate (32), which is provided to be brought into contact with the cams and pivoted by pivoting the cams and one end portion of which is engaged with the attaching means (arms 30), returning means (spring 50) for urging the operating plate in a release direction and an elastic member (torsional coil spring 51) having one end portion locked to the attaching means and the other end portion pressed by the operating plate moved in a pinch direction reverse to the release direction. According to the constitution, when the cams move the operating plate in the pinch direction against the returning means, the operating plate moves the attaching means in the pinch direction via the elastic member and sets the pinch rollers to the pinch positions. Further, when the cams permit the operating plate to move in the release direction by the returning means, the operating plate moves the attaching means in the release direction and sets the pinch rollers at the release positions.

According to a fifth aspect of the present invention, there is provided a rotary type stencil printing machine comprising, a printing drum (2) on which perforated stencil sheet is made to wrap and which is rotated, a press drum (10) arranged at a vicinity of the printing drum and rotated in a direction reverse to a direction of the printing drum, a paper discharge roll (61) arranged at a vicinity of the press drum and rotated in a direction the same as a direction of the press drum, pinch roller pairs (65) provided respectively rotatably at vicinities of the press drum and the paper discharge roll for pressing print sheet to the press drum and the paper discharge roll such that the print sheet which has been sandwiched between the printing drum and the press drum and printed is held and carried by the press drum and the paper discharge roll, pinch roller position adjusting means for adjusting positions of the pinch roller pairs in an axis line direction such that the pinch roller pairs can be brought into contact with predetermined positions of the print sheet, pinch roller releasing means for moving the pinch roller pairs between pinch positions at which the pinch roller pairs are brought into contact with the press drum and the paper discharge roll and release positions at which the pinch roller pairs are separated from the press drum and the paper discharge roll and controlling means (40) for controlling the pinch roller position adjusting means and the pinch roller releasing means such that the positions of the pinch rollers in the axis line direction are adjusted only when the pinch roller pairs are set to the positions separated from the press drum and the paper discharge roll.

According to a sixth aspect of the present invention, there is provided the rotary type stencil printing machine according to the fifth aspect, further comprising a sheet width sensor (17) for detecting a width of the supplied print sheet, wherein the pinch roller pairs (65) are two sets of pinch roller pairs for pressing two edge portions of the print sheet in a width direction to the press drum, the pinch roller position adjusting means comprising a pair of moving members (68) made movable in the width direction of the print sheet and respectively attached with the two sets of pinch roller pairs, moving means (69) for moving the pair of moving members in directions reverse to each other and a movement detecting sensor (26) for detecting positions of the moving members, the pinch roller releasing means comprising driving means (87) for setting the pinch roller pairs to the release positions or the pinch positions, cams (83) driven to rotate by the driving means, an operating member (70) provided to be brought into contact with the cams, pivoted by pivoting the cams and provided with the pair of moving members via the moving means and a release detecting sensor (37) for detecting whether the pinch roller pairs are brought into a release state and wherein the controlling means (40) sets the pinch roller pairs to the release positions by operating the driving means of the pinch roller releasing means after finishing a printing operation and controls the pinch roller position adjusting means in accordance with a signal from the sheet width sensor before carrying out the printing operation.

DETAILED DESCRIPTION OF THE PREFERRED EMBODIMENTS

Figure 15:
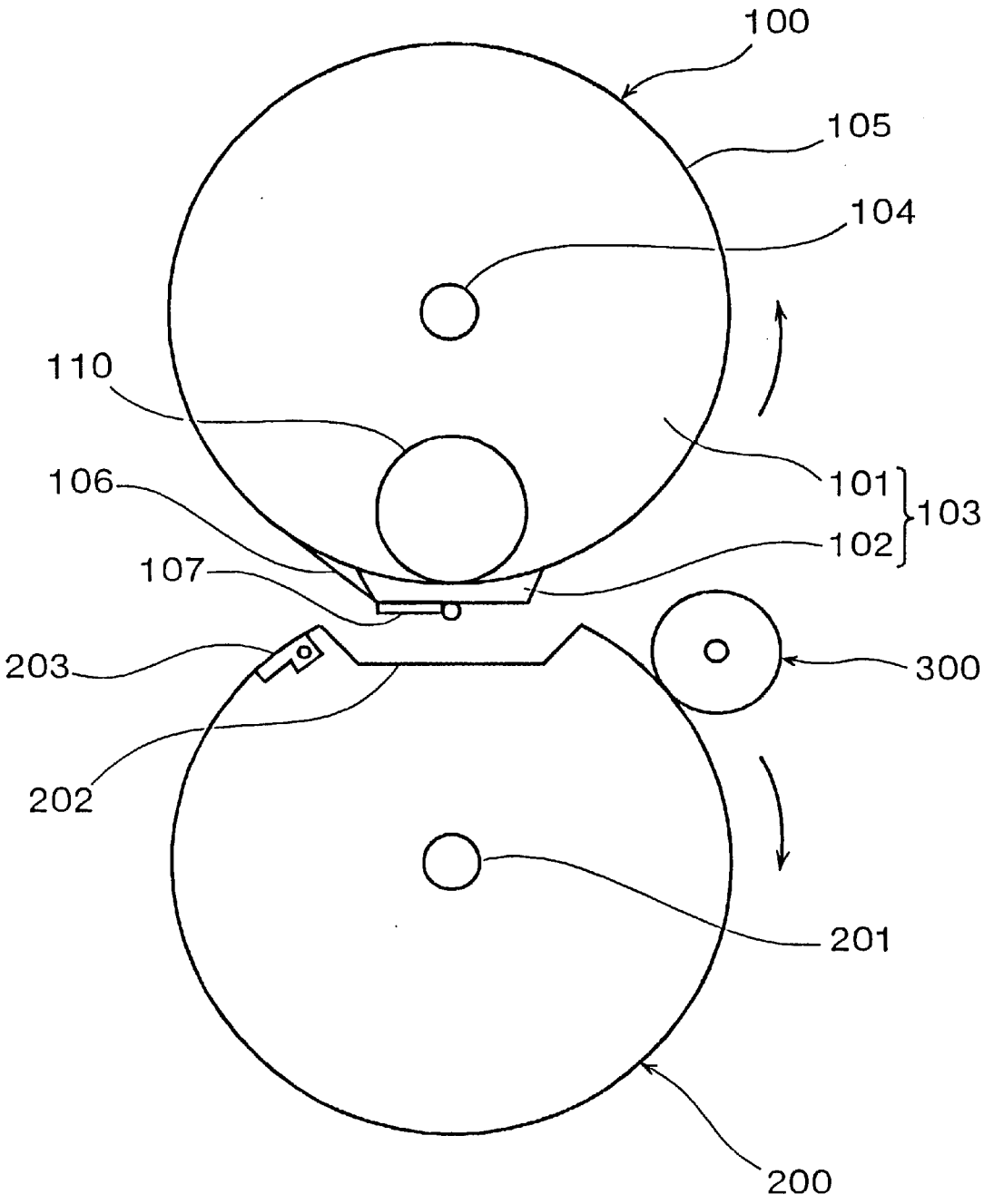
FIG. 15 is a sectional view showing a basic structure of a conventional stencil printing machine.
Figure 16:
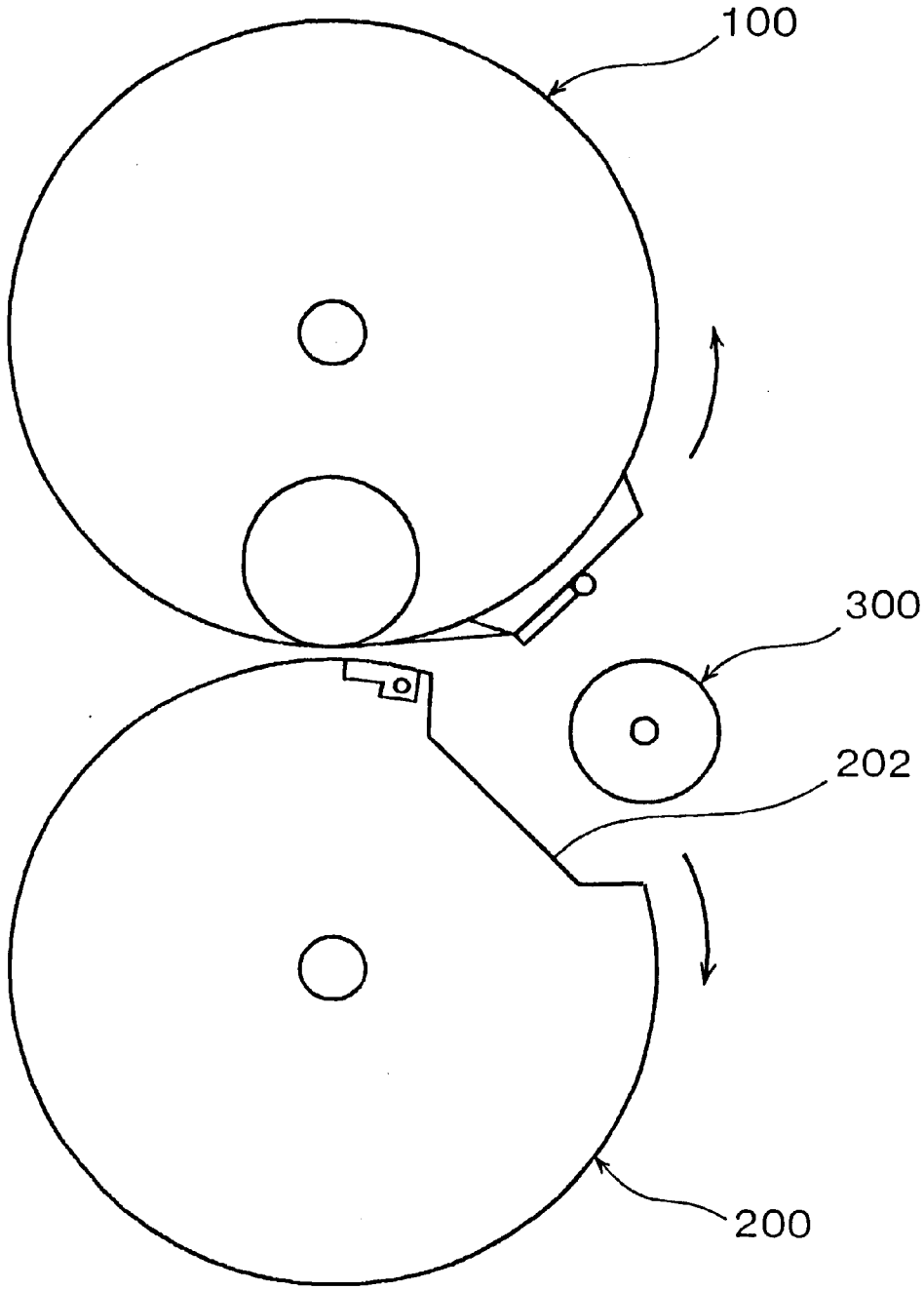
FIG. 16 Prior Art
FIG. 16 is a sectional view showing the basic structure of the conventional stencil printing machine.

An explanation will be given of a rotary type stencil printing machine 1 which is an example of an embodiment according to the present invention in reference to FIG. 1 through FIG. 9 as follows. In this example, an explanation will be given mainly of printing means comprising a printing drum and a press drum. Paper feeding means, paper discharging means, stencil perforating means, stencil discharging means, draft reading means and the like provided to the stencil printing machine of the example, are the same as those in a conventional machine shown in FIG. 15 and FIG. 16 and therefore, an explanation thereof will be omitted.

A printing drum 2 is provided with a base member 3. The base member 3 is provided with a pair of circular plate members 4 arranged coaxially on a common central axis line and a stencil clamping base 5 as a base element for connecting the pair of circular plate members 4. A longitudinal direction of the stencil clamping base 5 is in parallel with the central axis line of the circular plate members 4. The base member 3 is driven to rotate centering on the central axis line.

The stencil clamping base 5 is provided with clamping means 6 for holding a front end of stencil sheet.

One end portion of the stencil clamping base 5 is attached with one end portion of a screen member 7. The one end portion of the screen member 7 is disposed on the upstream side in the rotational direction of the printing drum 2. At least one portion of the screen member 7 is ink-permeable and is made of a flexible material. The screen member 7 is made to wrap on the base member 3 to be directed to the downstream side in the rotational direction such that a pair of side edge portions thereof are brought into sliding contact with peripheral faces of the pair of circular plate members 4. Other end portion of the screen member 7 is attached to other end portion of the stencil clamping base 5 via a spring. In this way, the screen member 7 is pulled to the downstream side in the rotational direction by elastic force of the spring and is made to wrap on the peripheral faces of the pair of circular plate members 4. Therefore, the screen member 7 constitutes a cylindrical shape as a whole. When the screen member 7 is pressed from an inner side thereof, the screen member 7 is bulged outwardly while sliding on the peripheral faces of the circular plate members 4 and returns to the original state by the spring when the press force is removed.

A squeegee roller 8 is provided at an inner portion of the printing drum 2. The squeegee roller 8 is provided to a pivoting member 9 and is vertically movable at the inner portion of the printing drum 2. The squeegee roller 8 is driven to rotate in a direction the same as the direction of the printing drum 2 in cooperation with the printing drum 2. Further, the squeegee roller 8 presses the screen member 7 outwardly by a predetermined timing in synchronism with rotation of the printing drum 2. Ink supplying means, not illustrated, supplies ink to the squeegee roller 8.

A press drum 10 is arranged on the lower side of the printing drum 2. A diameter of the press drum 10 is substantially the same as a diameter of the printing drum 2. In a nonprinting state, there is provided a very small clearance between the printing drum 2 and the press drum 10. The press drum 10 is driven to rotate in a direction reverse to that of the printing drum 2 in synchronism with rotation of the printing drum 2. A hold claw 11 for holding a front end of print sheet is provided openably and closably at an outer circumferential surface of the press drum 10. The outer circumferential surface of the press drum 10 is provided with a recess portion 12 for avoiding interference with the clamping means 6 of the printing drum.

Pinch rollers 15 are rotatably provided at a vicinity of the press drum 10. The pinch rollers 15 are arranged side by side on a sheet discharge side of the press drum 10. The pinch rollers 15 press print sheet immediately after having been printed to the press drum 10 and peel off the print sheet from the printing drum 2. Two pieces of the pinch rollers 15 are brought into contact with two edge portions in the width direction of print sheet 13.

Further, the rotary type stencil printing machine 1 of the example is provided with a sheet width sensor for detecting the width of the print sheet 13 supplied.

The two pieces of pinch rollers 15 are brought into contact with predetermined positions disposed at two end edges in the width direction of the print sheet 13. The predetermined positions are determined by the width of the print sheet 13. According to the example, there is provided pinch roller position adjusting means for adjusting positions of the pinch rollers 15 in an axis line direction thereof such that the pinch rollers 15 can be brought into contact with the predetermined positions of the print sheet 13 having various dimensions. Further, there is provided pinch roller releasing means for moving the pinch rollers 15 to release positions separated from the press drum 10. Further, there is provided controlling means for carrying out a control such that the pinch roller position adjusting means is operated only when the pinch rollers 15 are set to the release positions. That is, according to the example, the pinch rollers 15 are separated from the press drum 10 in a nonprinting state and the positions of the pinch rollers 15 in the axis line direction are adjusted in conformity with the size of the print sheet at the separated positions.

An explanation will be given of structures of the pinch rollers 15, the pinch roller position adjusting means and the pinch roller releasing means in reference to FIG. 1 and FIG. 2. In this example, there are provided two pieces of the pinch rollers 15 and the two pieces of pinch rollers 15 press the two edge portions of the print sheet in the width direction to the press drum 10.

The pinch roller position adjusting means is provided with a pair of moving members 20 which are made movable in the width direction of the print sheet 13. The pinch rollers 15 are moved along with the moving members 20. The moving members 20 are slidable relative to two pieces of shafts 22 which are attached to side plates 21 of the machine. A belt 23 which is moving means is made to hang around a pair of pulleys 24. One of the pulleys 24 is driven by a moving motor 25. The pair of moving members 20 are fixed to sides of the belt 23 opposed to each other. Therefore, the pair of moving members 20 are moved in directions opposed to each other along the shafts 22 when the moving motor 25 is driven. That is, the pair of moving members 20 are moved in directions separating from each other or moved in directions approaching each other.

Further, the pinch roller position adjusting means is provided with a movement detecting sensor for detecting the positions of the moving members 20.

The pinch roller releasing means is provided with arms 30 pivotably attached to the moving members 20. The pinch rollers 15 are pivotably attached to front ends of the arms 30. The arms 30 are pivoted between pinch positions where the pinch rollers 15 are brought into contact with the press drum 10 and release positions where the pinch rollers 15 are separated from the press drum 10.

Figure 3:
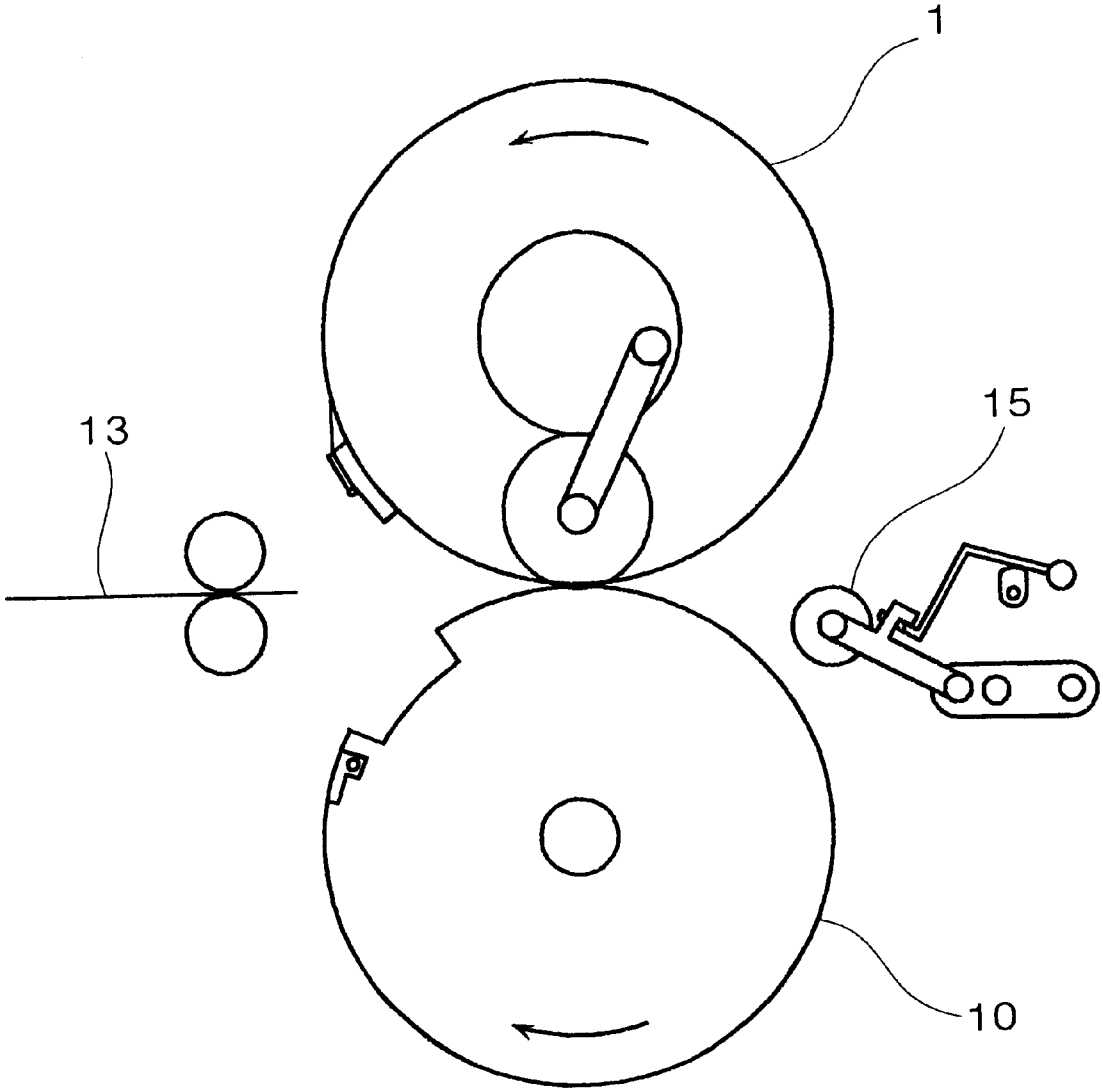
FIG. 3 is a sectional view showing a nonprinting state in the first example of the embodiment according to the present invention.
Figure 4:
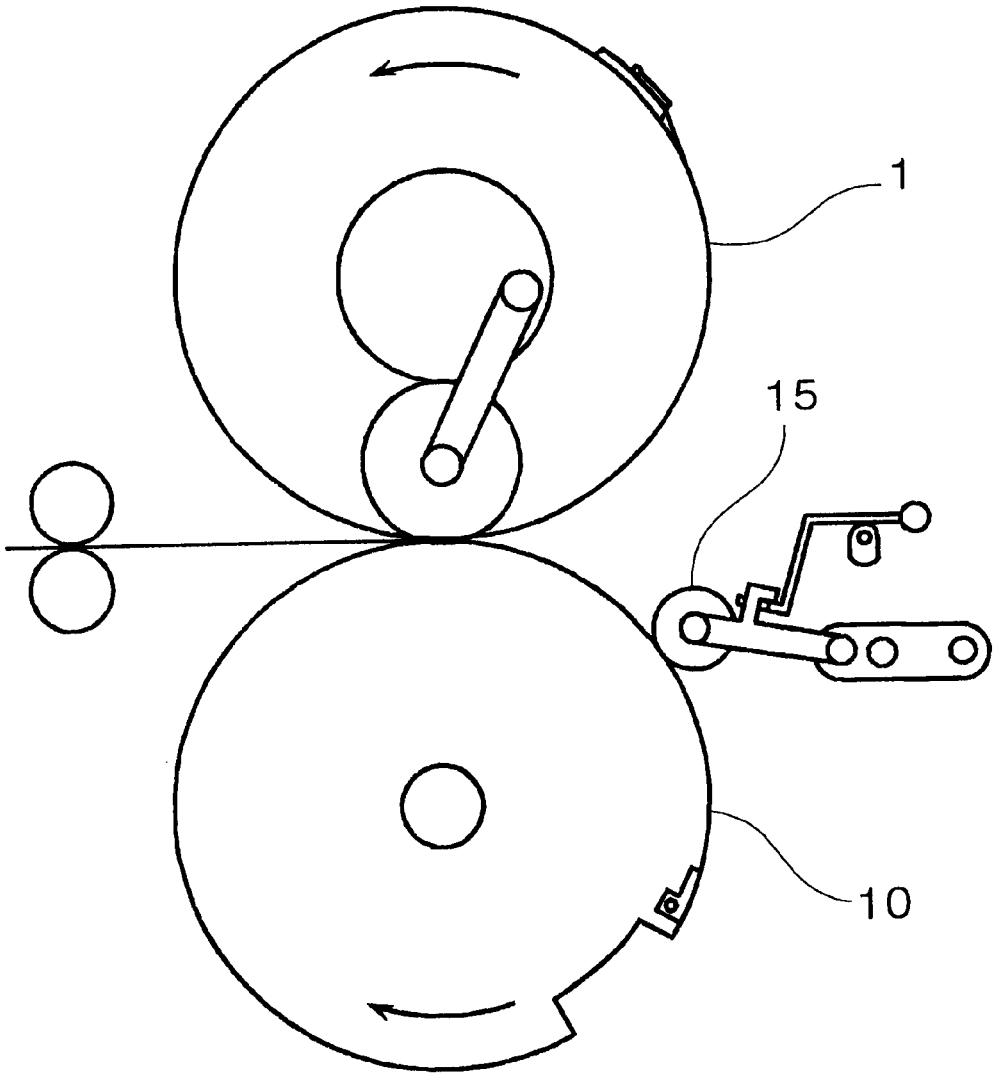
FIG. 4 is a sectional view showing a printing state in the first example of the embodiment according to the present invention.
Figure 5:
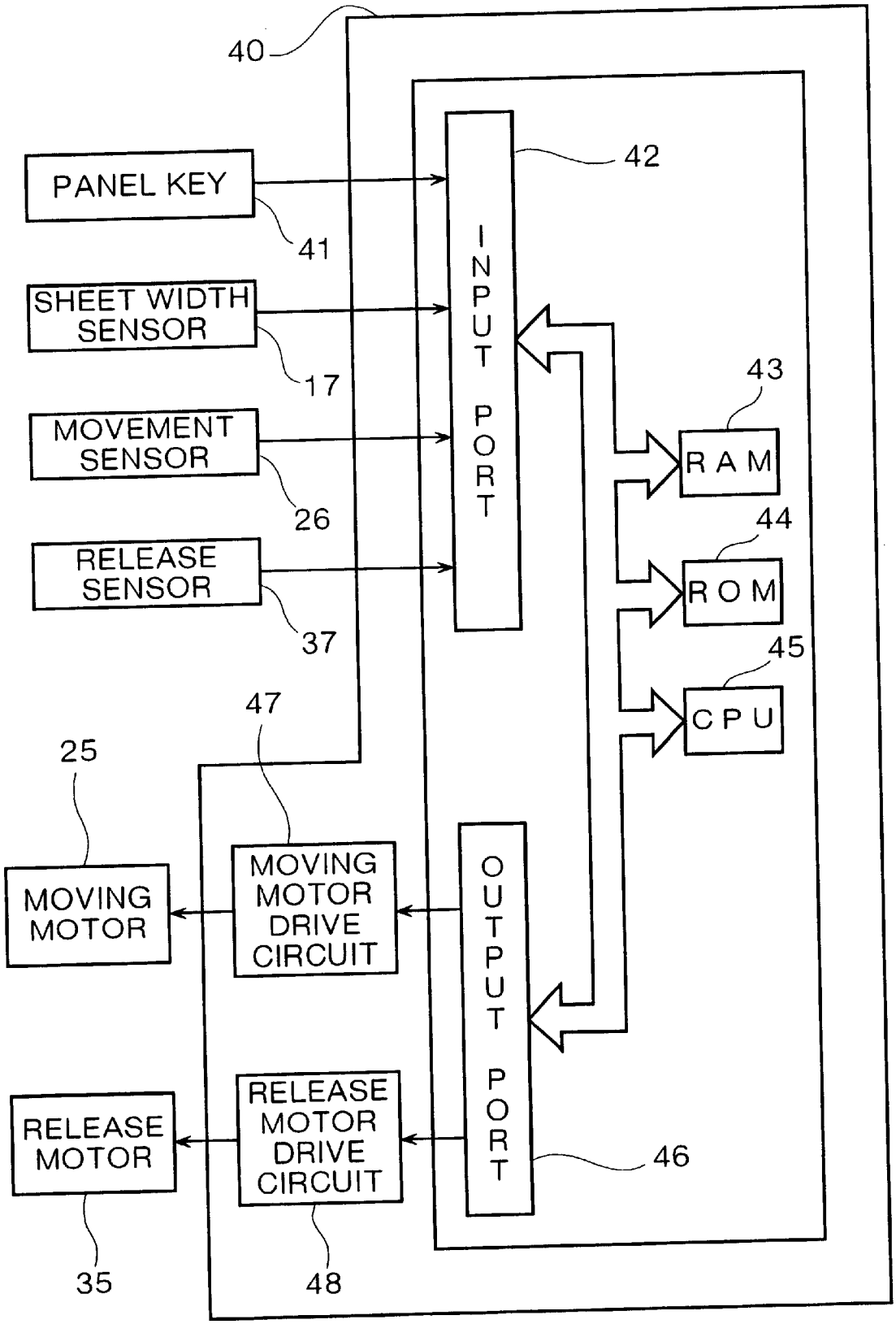
FIG. 5 is a block diagram of controlling means in the first example of the embodiment according to the present invention.

First, there is provided an operating plate 32 for pivoting around a shaft 31 in parallel with the shafts 22 between the side plates 21 of the machine. The operating plate 32 is formed with a groove 33 along the longitudinal direction and the groove 33 is movably engaged with engaging portions 34 of the arms 30. The pinch roller releasing means is provided with a release motor 35 and a release cam 36 pivoted by the release motor 35 as driving means. The release cam 36 is brought into contact with a lower face of the operating plate 32. When the release motor 35 rotates the release cam 36, the operating plate 32 is pivoted centering on the shaft 31. When the operating plate 32 is pivoted, two pieces of the arms 30 engaged with the operating plate 32 are pivoted along therewith and accordingly, two pieces of the pinch rollers 15 are also pivoted. FIG. 3 shows a state in which the pinch roller 15 is separated from the press drum 10. FIG. 4 shows a state in which the pinch roller 15 is brought into contact with the press drum 10 by its own weight.

Further, the pinch roller releasing means is provided with a release detecting sensor for detecting whether the pinch rollers 15 are brought into a release state.

The stencil printing machine according to the example is provided with controlling means 40. Although the controlling means 40 controls a total of the machine, in FIG. 5, there is shown only a portion thereof related to control of the pinch rollers 15. The controlling means 40 receives an input from a panel key 41 of the machine, a signal from a sheet width sensor 17, a signal from a movement sensor 26 and a signal from a release sensor 37 from an input port 42. Based on programs and data stored to RAM 43 and ROM 44, CPU 45 processes information of these and outputs a control signal from an output port 46. The outputted control signal is provided to a moving motor drive circuit 47 and drives the moving motor 25, thereby, a clearance between two pieces of the pinch rollers 15 is set. The outputted control signal is provided to a release motor drive circuit 48 and drives the release motor 35, thereby, two pieces of the pinch rollers 15 are lifted and set to the release positions.

The controlling means 40 sets the pinch rollers 15 to the release positions by operating the release motor 35 after the printing operation. Before the printing operation, the moving motor 25 is driven in accordance with the signal from the sheet width sensor 17 and the clearance in the axial direction between the pinch rollers 15 disposed at the release positions is adjusted.

Figure 1:
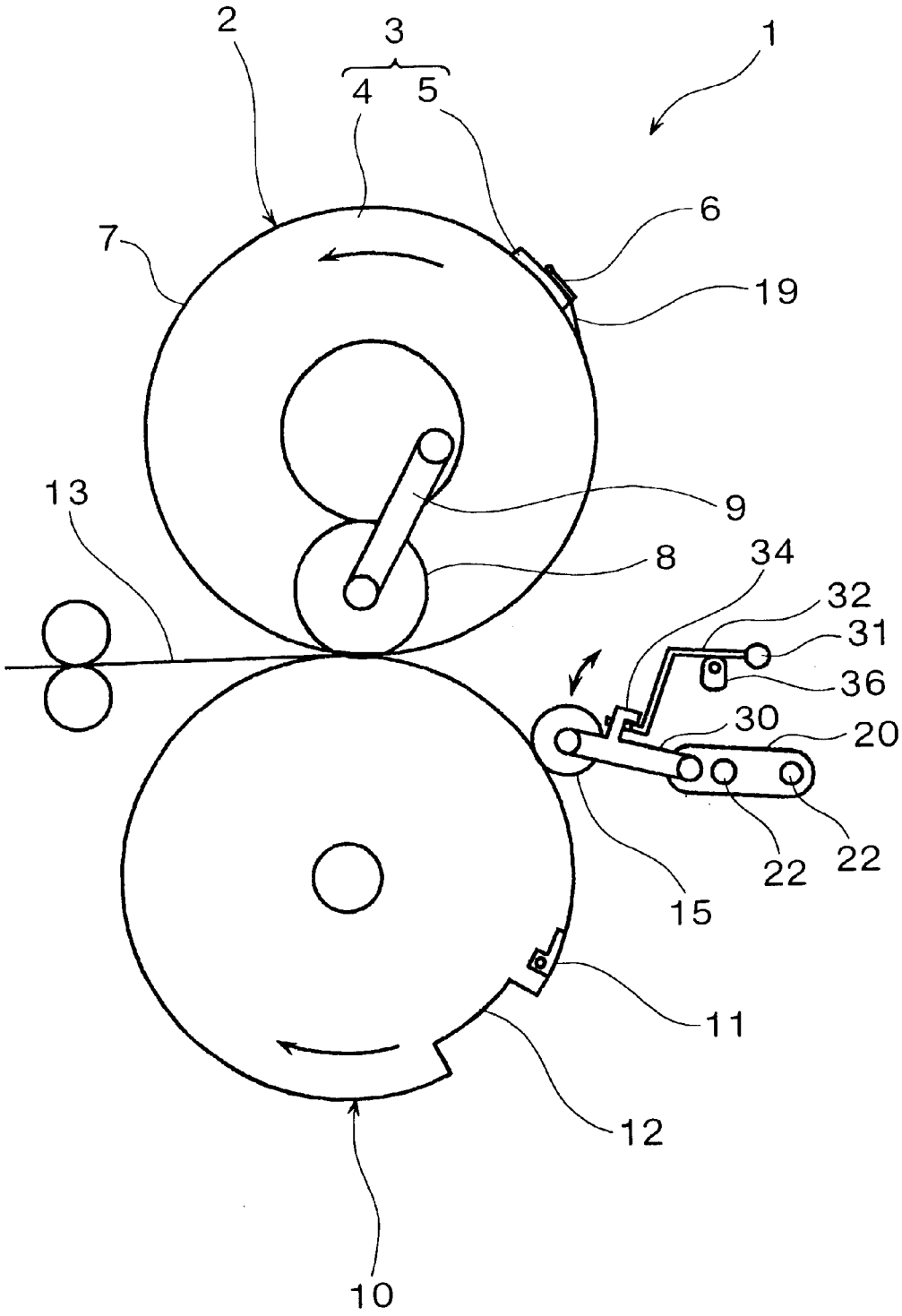
FIG. 1 is a sectional view showing a first example of an embodiment according to the present invention.
Figure 2:
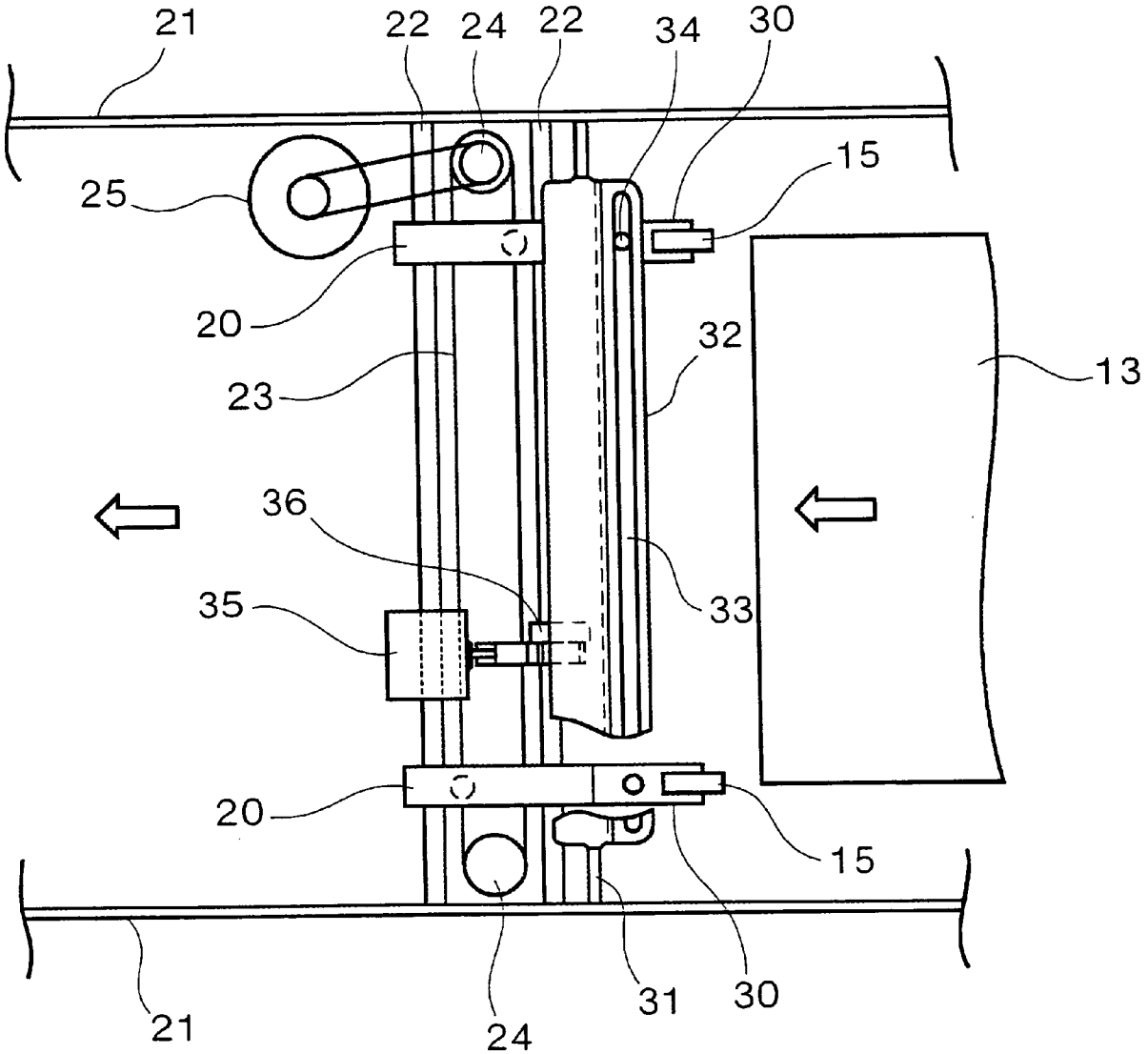
FIG. 2 is a plane view showing a vicinity of pinch rollers according to the first example.

As shown by FIG. 1, the print sheet 13 is supplied between the printing drum 2 and the press drum 10. The press drum 10 is rotated while holding the front end of the print sheet 13 by the hold claw 11 and the printing drum 2 is rotated in synchronism with the press drum 10. The squeegee roller 8 is lowered at the predetermined timing and presses the screen member 7 outwardly. The screen member 7 and the stencil sheet 19 which are deformed outwardly, sandwich the print sheet 13 between the press drum 10 and the screen member 7 as well as the stencil sheet 19. The print sheet 13 is carried by being sandwiched between the deformed printing drum 2 and the press drum 10. While carrying the print sheet 13, ink supplied to the inner circumferential face of the screen member 7 is transcribed onto the print sheet 13 after passing through the screen member 7 and the stencil sheet 19 and forms an image.

The print sheet 13 coming out from between the printing drum 2 and the press drum 10 is pressed to the press drum 10 side by the pinch rollers 15. Thereby, the print sheet 13 stuck to the print drum 2 side by the ink is peeled off by the pinch rollers 15. After the print sheet 13 passes through the pinch rollers 15, the hold claw 11 is released and the print sheet 13 is discharged onto a tray for discharging sheet, not illustrated.

An explanation will be given of the control of the pinch rollers 15 in the operation of the machine.

Figure 6:
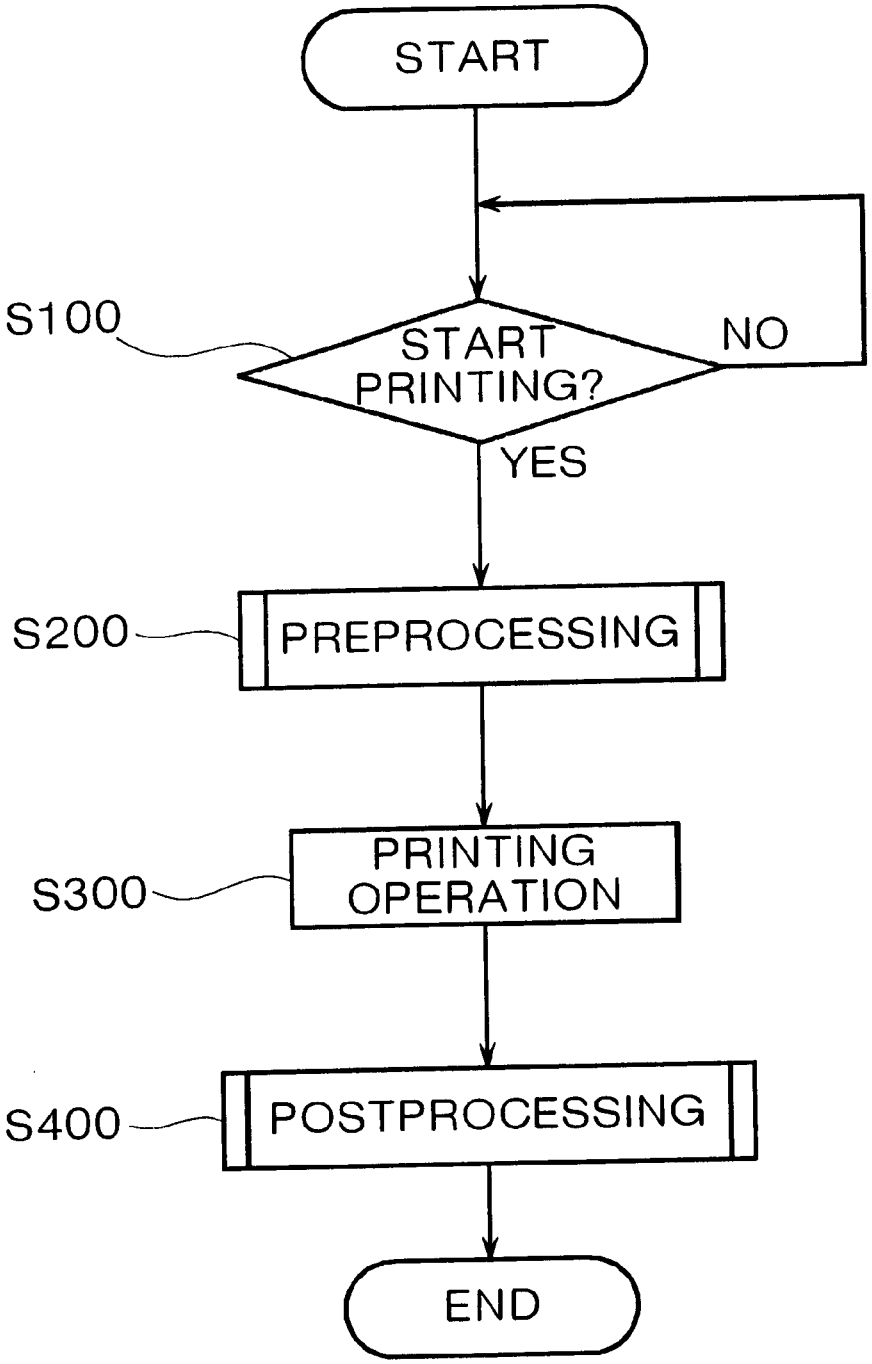
FIG. 6 is a flow chart showing control operation in the first example of the embodiment according to the present invention.

As shown by FIG. 6, at step 100 (designated by S100 in the drawing), it is determined whether the printing operation is started. Specifically, the controlling means 40 determines whether a print start button of the panel key 41 is depressed. Next, at step 200, a preprocessing is carried out. Next, at step 300, the printing operation is carried out. Next, at step 400, a postprocessing is carried out and a series of processings is finished.

An explanation will be given of a procedure of the preprocessing indicated in step 200 in reference to FIG. 7 and FIG. 8.

Figure 7:
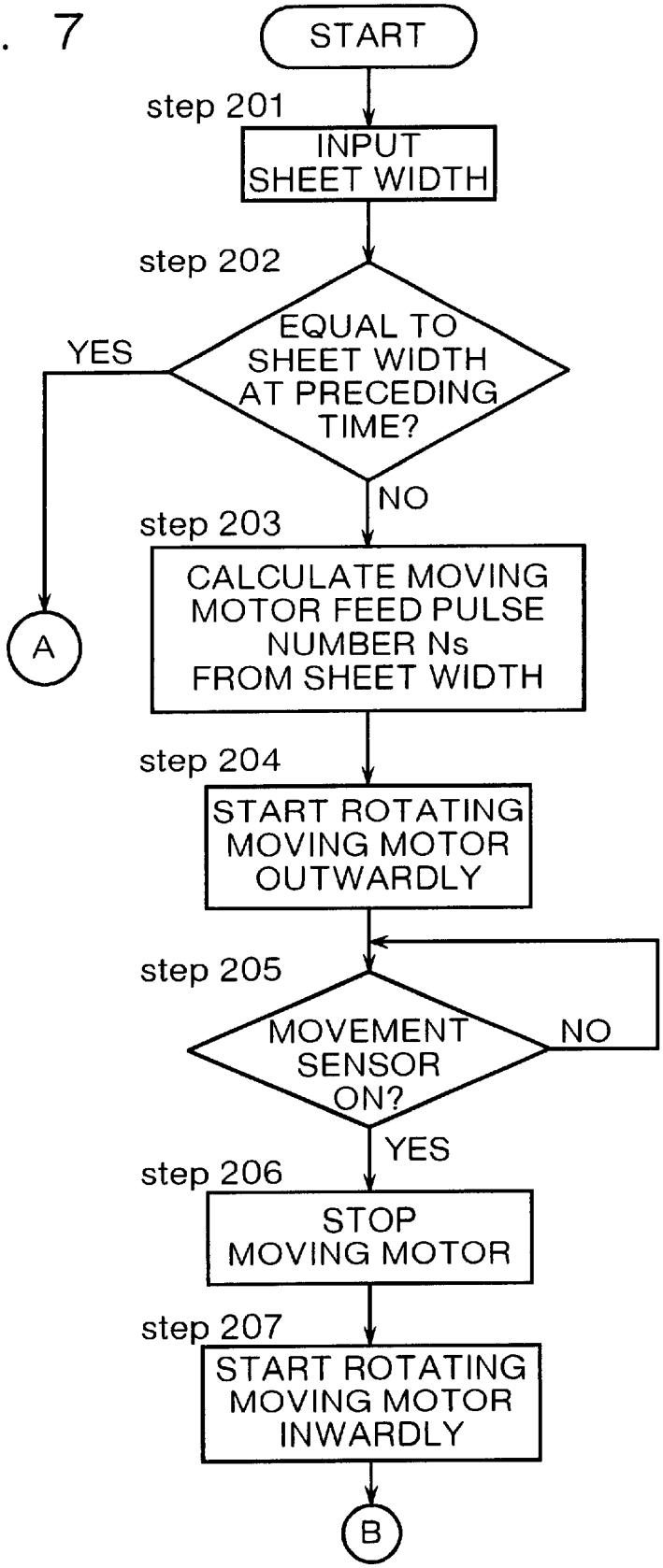
FIG. 7 is a flow chart showing the control operation in the first example of the embodiment according to the present invention.

As shown by FIG. 7, at step 201, information of sheet width for print sheet 13 to be printed successively is inputted from the sheet width sensor 17. At step 202, it is determined whether the sheet width of the print sheet 13 is equal to a width of print sheet 13 which has been printed at a preceding time. When the widths are equal, it is not necessary to change the clearance between two pieces of the pinch rollers 15 and the procedure proceeds to 'A' of FIG. 8. When the widths are not equal, at step 203, an amount of driving the moving motor 25 necessary for moving the pinch rollers 15 from original point positions to positions in correspondence with a new sheet width is calculated as a number of motor feed pulses. The pulse number is designated by notation Ns. At step 204, the moving motor 25 is driven and the pair of pinch rollers 15 are moved in directions separating from each other. At step 205, it is determined whether the movement sensor 26 detects the moving members 20. Detection of the moving members 20 by the movement sensor 26 signifies that the moving members 20 and the pinch rollers 15 return to the original point positions. At step 206, the moving motor 25 is stopped. At step 207, the number of motor feed pulses provided at step 203 is provided to the moving motor 25 to thereby start to drive the moving motor 25 and the pair of pinch rollers 15 start moving in directions approaching each other. Once the moving members 20 move away from the original point positions, the movement sensor 26 is made OFF.

Figure 8:
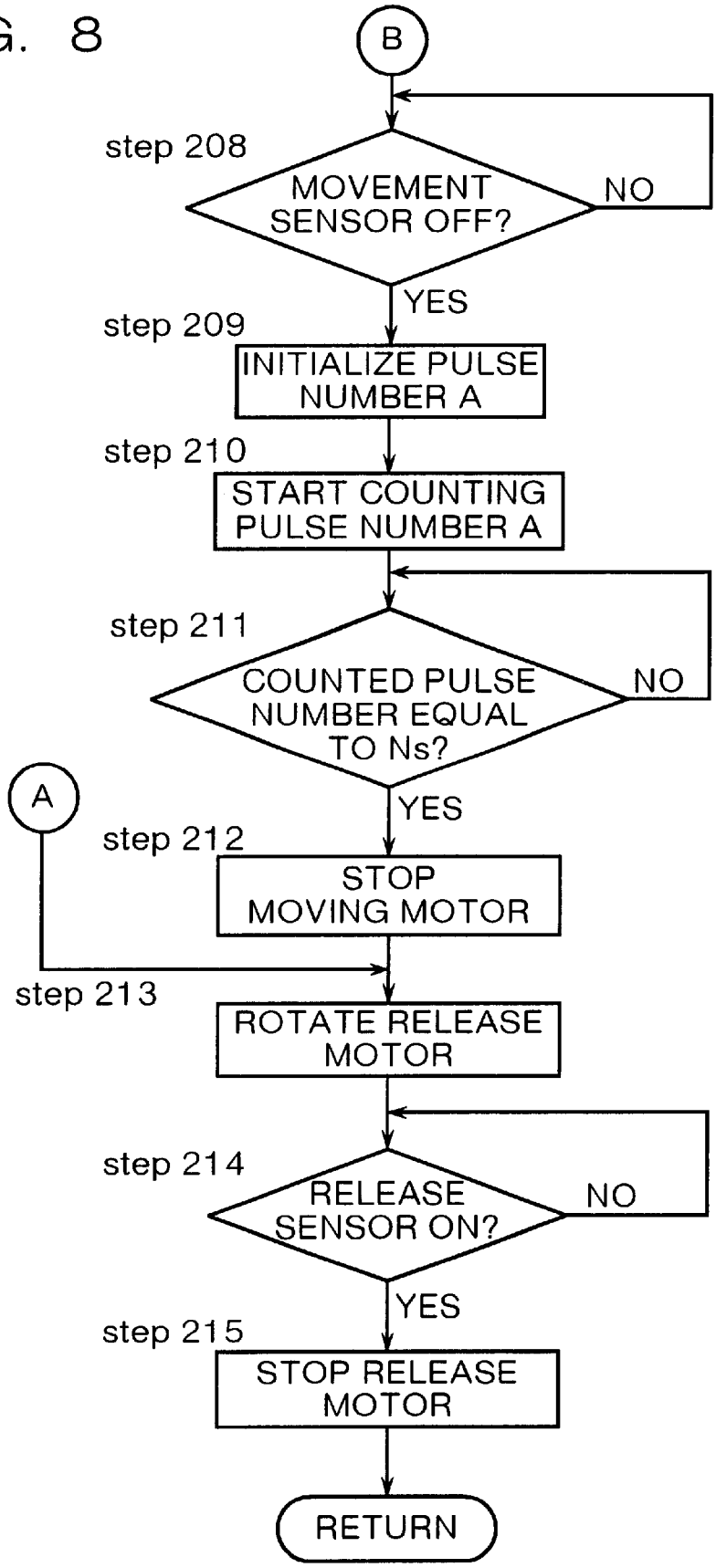
FIG. 8 is a flow chart showing the control operation in the first example of the embodiment according to the present invention.

As shown by FIG. 8, at step 208, when it is determined that the movement sensor 26 is made OFF, at step 209, a number of pulses of a counter stored with a number of pulses for driving the moving motor 25 is initialized and at step 210, counting of the number of pulses for driving the moving motor 25 is started. At step 211, when it is determined that the counted number of pulses for driving the moving motor 25 reaches Ns, at step 212, the moving motor 25 is stopped.

When the sheet width of the print sheet 13 is equal to that in the preceding time, that is, when determination at step 202 of FIG. 7 is YES, the operation proceeds to step 213 shown in FIG. 8. That is, the operation of adjusting the clearance between the pinch rollers 15 becomes unnecessary and at step 213, the release motor 35 is rotated. The pinch rollers 15 are lowered from the release positions and brought into contact with the press drum 10. At step 214, when the release sensor 37 is made ON and there is brought about a state in which the pinch rollers 15 are brought into contact with the press drum 10 and pressed, at step 215, the release motor 35 is stopped.

Next, the printing operation is carried out at step 300 in FIG. 6. After the printing operation, the postprocessing is carried out as shown by step 400 in FIG. 6. An explanation will be given of the postprocessing in reference to FIG. 9.

Figure 9:
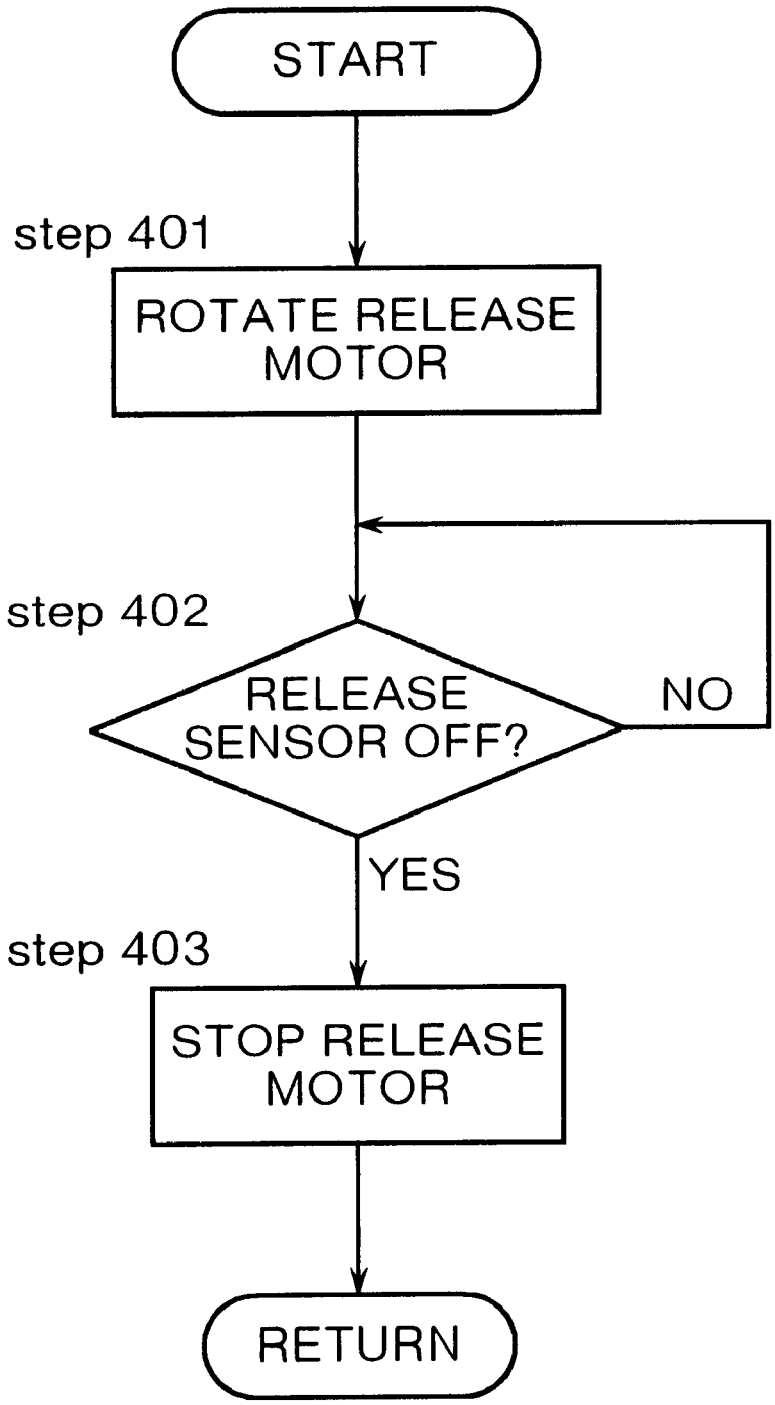
FIG. 9 is a flow chart showing the control operation in the first example of the embodiment according to the present invention.

As shown by FIG. 9, at step 401, the release motor 35 is rotated and the pinch rollers 15 are lifted and are moved in a direction separating from the press drum 10. At step 402, when it is confirmed that the release sensor 37 is made OFF, at step 403, the release motor 35 is stopped. According to the postprocessing step, the pinch rollers 15 are disposed always at positions escaped from the press drum 10, that is, the release positions at other than the printing operation.

Next, an explanation will be given of other embodiment of a rotary type stencil printing machine according to the present invention in reference to FIG. 10 and FIG. 11. An explanation will be given of points different from the first example. According to the example, the operating plate 32 is hung by a spring 50 as returning means. The release cam 36 is arranged on an upper side of the operating plate 32. A torsional coil spring 51 as an elastic member is interposed between the moving member 20 and the arm 30. An upper side end portion of the torsional coil spring 51 is pressed downwardly by the operating plate 32 which is lowering. A lower side end portion of the torsional coil spring 51 is locked by a lock piece formed at the arm 30. By the torsional coil spring 51, pressure for pressing the pinch rollers 15 to the press drum 10 is set.

Figure 10:
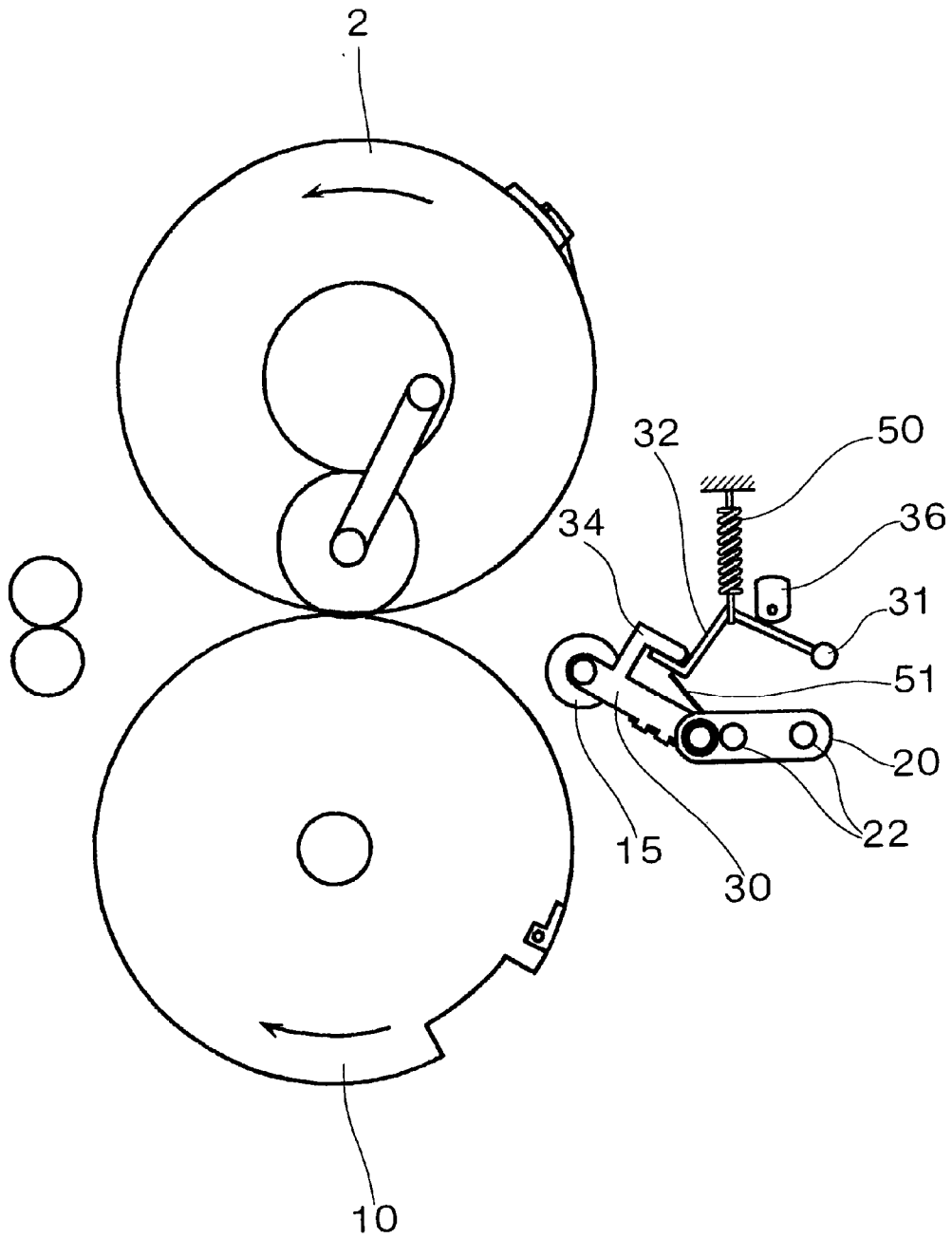
FIG. 10 is a sectional view showing a nonprinting state in a second example of the embodiment according to the present invention.

When a projected portion of the release cam 36 is disposed on the upper side as shown by FIG. 10, the operating plate 32 is pulled back upwardly by the spring 50. The arm 30 provided with the pinch roller 15 is pulled up to an upper escaping position by the operating plate 32. That is, the pinch roller 15 is separated from the press drum 10.

Figure 11:
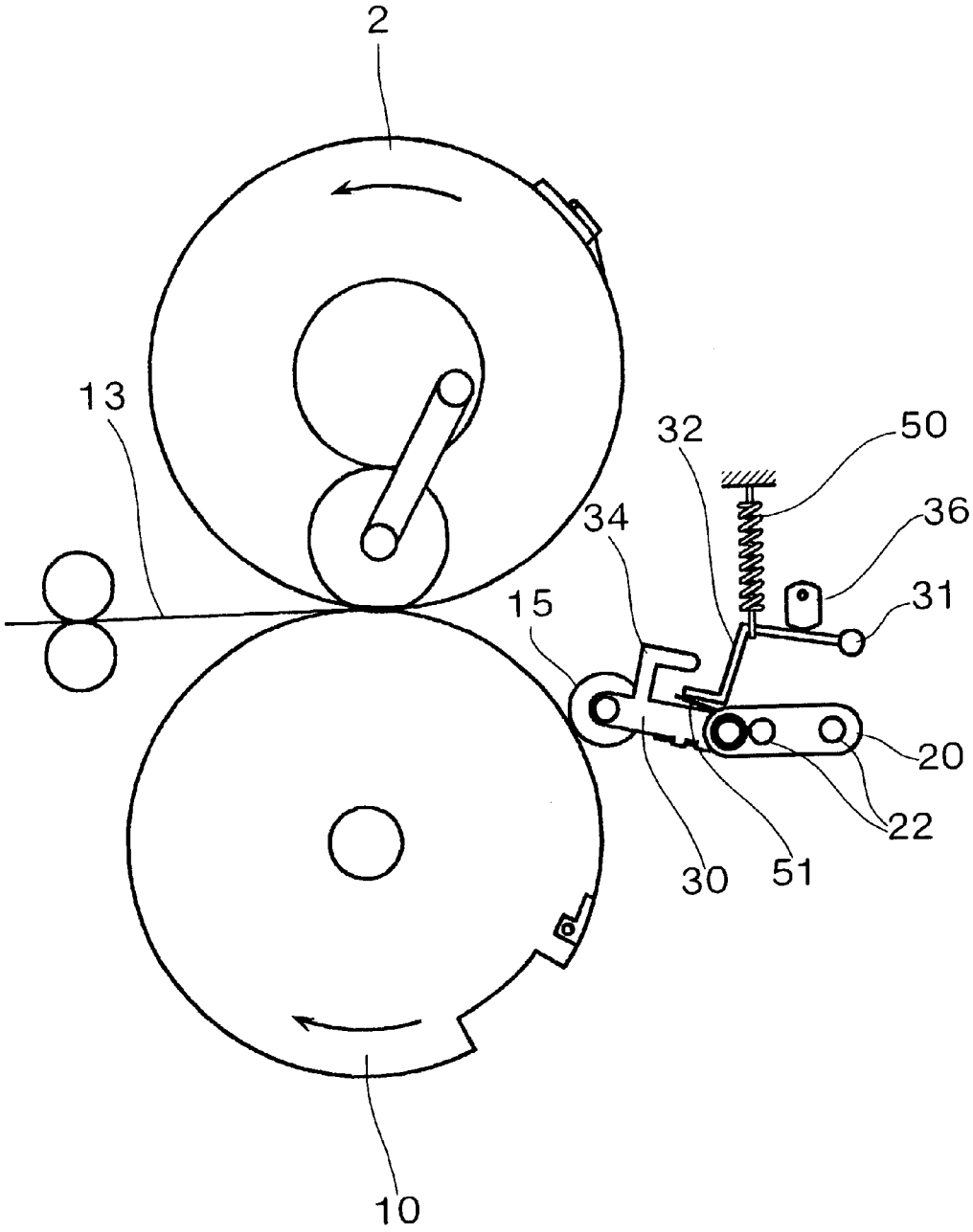
FIG. 11 is a sectional view showing a printing state in the second example of the embodiment according to the present invention.

When the release cam 36 is rotated and the projected portion is disposed on the lower side as shown by FIG. 11, the release cam 36 pushes down the operating plate 32 by elongating the spring 50. The pushed-down operating plate 32 pushes down the upper side end portion of the torsional coil spring 51. The arm 30 receives downward force via the torsional coil spring 51. The pinch roller 15 is pressed to the press drum 10 by the elastic force of the torsional coil spring 51. That is, according to the example, pressure of pressing the press drum 10 by the pinch roller 15 is set to a predetermined value by the torsional coil spring 51. Further, by changing the shape of the release cam, the pressure can be changed.

When the projected portion of the release cam escapes from the operating plate 32 as shown by FIG. 10, the operating plate 32 moves upwardly by recovery force of the spring 50, thereby, the arm 30 is lifted and the pinch roller 15 is separated from the press drum 10.

According to the above-described embodiment, the pinch roller 15 is pulled up and is set to the release position where the pinch roller 15 is not brought into contact with the outer circumferential surface of the press drum 10 at other than the case in which the print sheet is passed between the printing drum 2 and the press drum 10, that is, at other than the printing operation. Therefore, movement of the pinch roller 15 in the axial direction, that is, adjustment of the clearance can be carried out without rotating the press drum 10. Further, deterioration of the pinch roller 15 can be retarded. Further, when jammed sheet is removed by removing the printing drum 2 from the main body, operation is facilitated since the pinch rollers 15 are pulled up.

Further, according to the above-described embodiment, by adjusting the shape of the release cam 36 or the position of the release cam 36 in the rotational direction, a state in which the pinch rollers 15 are brought into contact with the press drum 10 can be changed. That is, nip pressure by which the pinch rollers 15 hold the print sheet on the paper drum 10 can be adjusted. Therefore, in the case of soft print sheet which is easy to be impressed by a nip mark, there is facilitated adjustment of nip pressure in conformity with the sheet such as reducing the nip pressure.

According to the above-explained embodiments, movement of the pinch rollers 15 in the axial direction and movement thereof relative to the press drum 10 are carried out by the motors 25 and 35 and the cam 36. Further, in transmitting the drive force, there are adopted the belt 23 and link mechanisms of the pivoting arms 30 and the like. However, selection of the driving means is arbitrary, a solenoid or the like can be used other than the motor and in transmitting the drive force, further various mechanisms can be adopted.

Next, an explanation will be given of other embodiment of a rotary type stencil printing machine according to the present invention in reference to FIG. 12 through FIG. 14. An explanation will be given of only points different from the first example.

Figure 12:
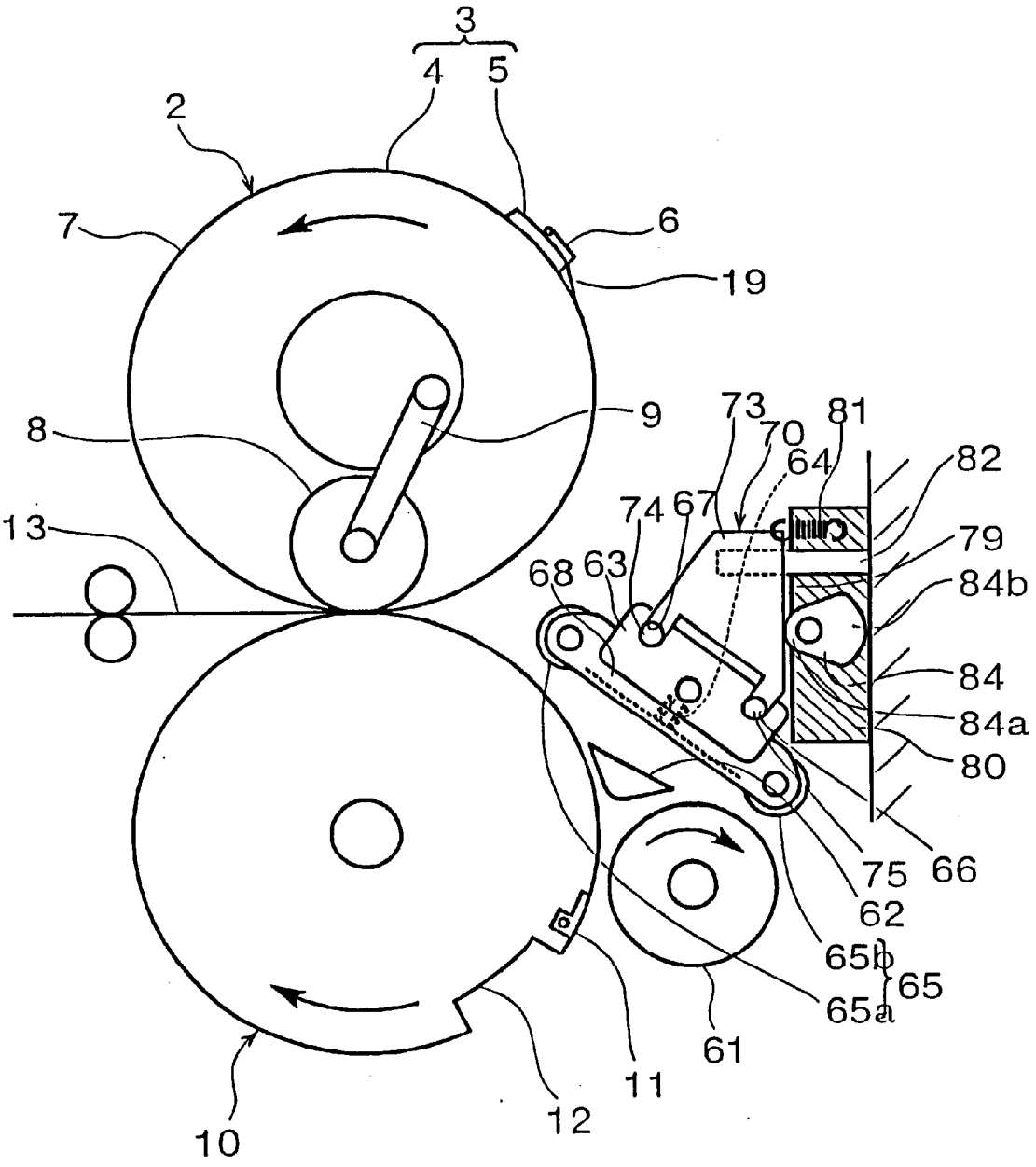
FIG. 12 is a sectional view showing a nonprinting state in a third example of an embodiment according to the present invention.
Figure 13:
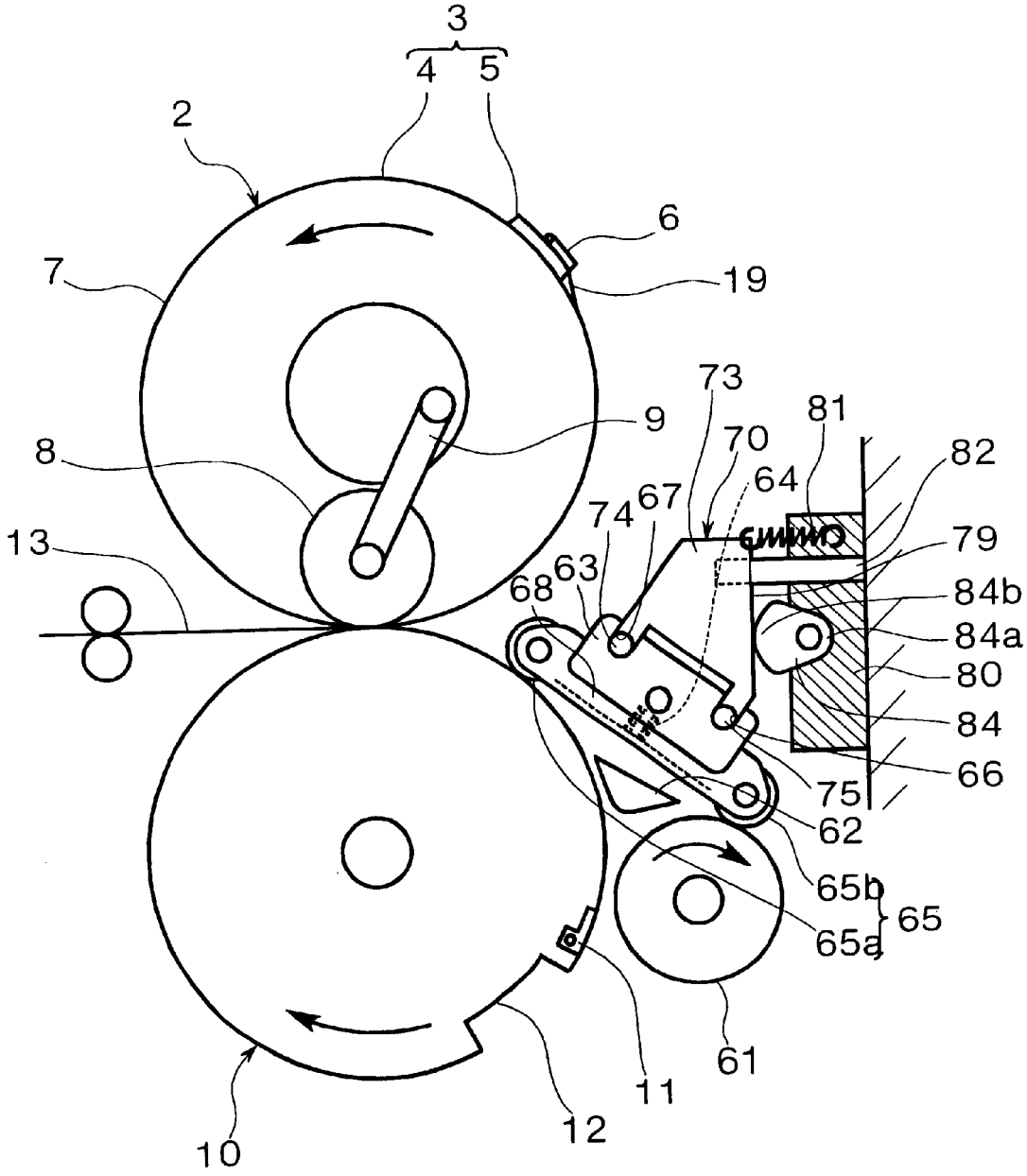
FIG. 13 is a sectional view showing a printing state in the third example of the embodiment according to the present invention.

As shown by FIG. 12 and FIG. 13, a discharge roll 61 is provided at a vicinity of the press drum 10 with a predetermined clearance therebetween. An axis line direction of the discharge roll 61 is the same as the axis line directions of the printing drum 2 and the press drum 10. The discharge roll 61 is rotated in a direction the same as the rotational direction of the press drum 10. A diameter of the discharge roll 61 is smaller than the diameter of the press drum 10. A guide member 62 for guiding the printed print sheet 13 to the discharge roll 61 side is provided between the press drum 10 and discharge roll 61.

According to the example, as pinch rollers, there are used two sets of pairs of pinch rollers 65*a* and 65*b* (pinch roller pairs 65). Ones of the pinch roller pairs 65 (first pinch rollers 65*a*) are disposed at a vicinity of the outer circumferential surface of the press drum 10 and others (second pinch rollers 65*b*) thereof are disposed at a vicinity of an outer circumferential surface of the discharge roll 61. The pinch roller pairs 65 are for pressing the outer circumferential surfaces of the press drum 10 and the discharge roll 61.

Next, an explanation will be given of pinch roller position adjusting means. The pinch roller position adjusting means is provided with moving members 68. The pinch roller pairs 65 are rotatably attached to both ends of the moving members 68. The longitudinal directions of the moving members 68 are in parallel with a common tangential line of the press drum 10 and discharge roll 61. Connecting plates 63 are attached to middle portions of the moving members 68. The connecting plates 63 are formed with screw holes 66 and through holes 67 in the longitudinal directions. Further, as shown by FIG. 12 and FIG. 13, the moving members 68 and connecting plates 63 are connected further by coil springs 64. Thereby, the pinch roller pairs 65 can apply nip pressure for pressing the print sheet to the press drum 10 and the discharge roll 61.

Next, an explanation will be given of moving means 69. As shown by FIG. 14, the moving means 69 is provided at an operating member 70. The operating member 70 is formed substantially in a box-like shape directing an opening portion 71 thereof substantially downwardly. A supporting member 72 is provided at the center of the opening portion 71 in parallel with side plates 73 of the operating member 70. Further, a shaft 74 is provided in the opening portion 71 in parallel with the axis line direction. The shaft 74 is inserted through the through holes 67 of the connecting plates 63. Further, the shaft 74 penetrates the supporting member 72.

Further, screw shafts 75 are axially supported respectively between the side plates 73 in the opening portion 71 and the supporting member 72. One end of each of the screw shafts 75 is screwed to a screw hole (not illustrated) formed at the side plate 73 and is projected from the side plate 73. Other ends of the respective screw shafts 75 are axially supported by the supporting member 72. Two pieces of the screw shafts 75 are provided on a straight line along the axis line direction. Further, the respective screw shafts 75 are screwed to the screw holes 66 of the connecting plates 63.

Further, pairs of pulleys 76 (76*a*, 76*b*) are provided on outer sides of the respective side plates 73. Belts 77 are hung around the pairs of pulleys 76. The pulleys 76*a* on one side attached to the screw shaft 75 are projected from the side plates 73. The pulleys 76*b* on other side are connected to moving motors 78 via the side plates 73.

That is, when the moving motors 78 are driven at a predetermined timing, the pair of moving members 68 are moved in directions reverse to each other by being guided by the screw shaft 75 and the shaft 74.

Next, an explanation will be given of pinch roller releasing means. The pinch roller releasing means is provided with the operating member 70. As shown by FIG. 12 and FIG. 13, a holding member 80 fixed to an inner portion of the main body of the machine is provided on a front face plate 79 side of the operation member 70. The holding member 80 is provided with coil springs 81, a support shaft 82 and a release cam 83. A hook of one end of each of the coil springs 81 is hung to the holding member 80. A hook of other end thereof is hung to an upper portion of the operating member 70. An upper plate of the operating member 70 is provided with a wall thickness larger than those of the side plates 73 and the front face plate 79. The support shaft 82 is inserted through the large wall thickness portion. The release cam 83 is axially supported pivotably by the holding member 80.

Figure 14:
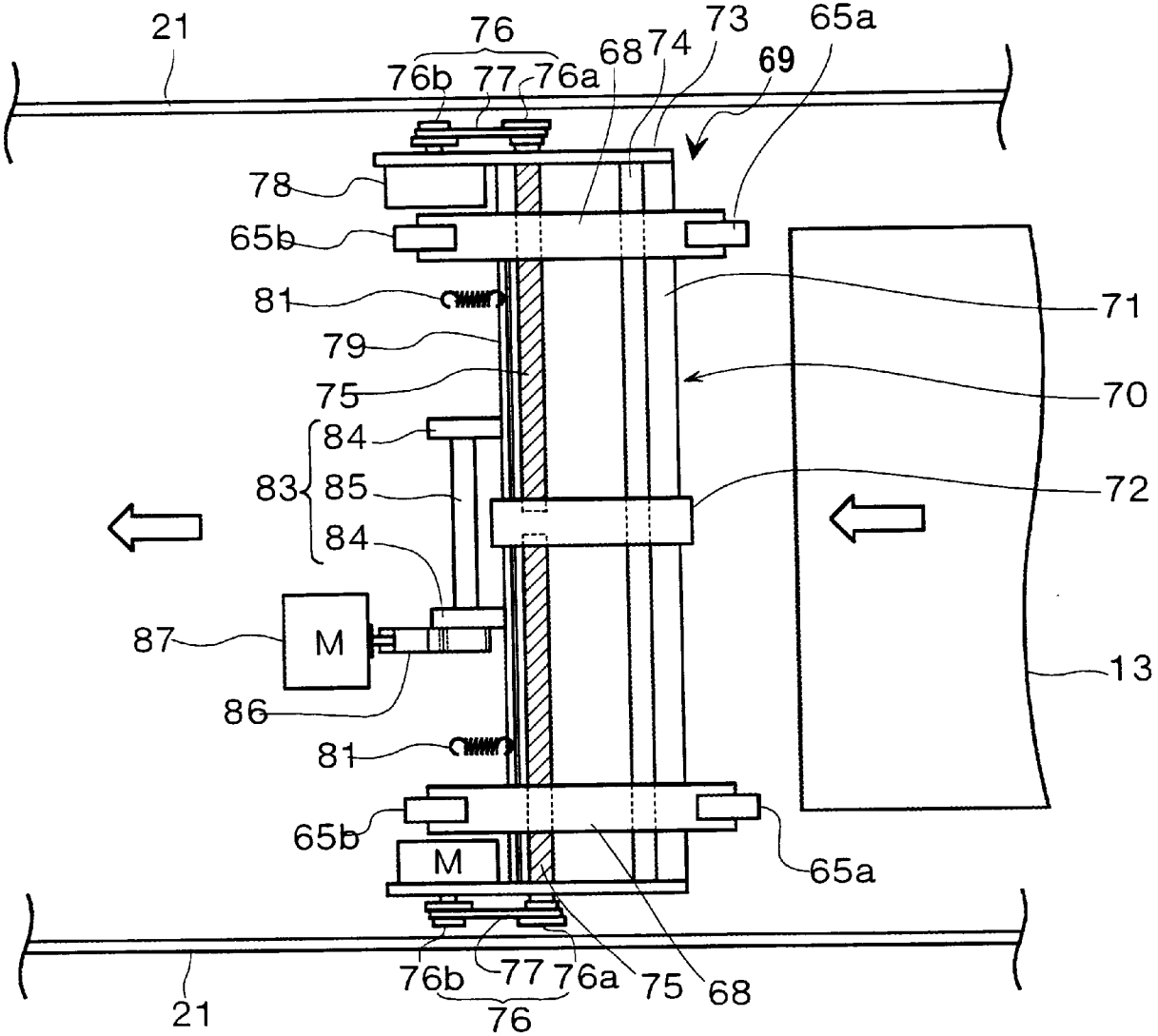
FIG. 14 is a plane view showing a vicinity of pinch rollers in the third example.

Further, as shown by FIG. 14, the release cam 83 is provided with a pair of cam portions 84. A shaft 85 is provided in the axis line direction between the cam portions 84. The shaft 85 is fixed to fixing ends 84*a* of the respective cam portions 84 and axially supports pivotably totals of the cam portions 84. The cam portions 84 are provided with a release motor 87 as driving means via a power converting mechanism 86. Further, although not illustrated, the operating member 70 is slidably supported by side plates of the main body.

Next, an explanation will be given of operation of the main body. As shown by FIG. 12, when the pinch roller pairs 65 are set to release positions, the fixing ends 84*a* of the cam portions 84 are brought into contact with the front face plate 79 of the operating member 70. When the release motor 87 is driven from the state, the release cams 84 are rotated by 180 degree. Further, as shown by FIG. 13, projected pieces 84*b* of the cam portions 84 are brought into contact with the front face plate 79 of the operating member 70. Thereby, the operating member 70 is slidably moved relative to the support shaft 82. Further, the operating member 70 becomes remote from the holding member 80 and the coil springs 81 are pulled.

At this occasion, the first pinch rollers 65*a* press the outer circumferential surface of the press drum 10. Further, at the same time, the second pinch rollers 65*b* press the outer circumferential surface of the discharge roll 61. This state indicates the pinch position. Further, as shown by FIG. 13, the print sheet 13 is supplied to between the printing drum 2 and the press drum 10. The press drum 10 is rotated while the holding the front end of the print sheet 13 by the hold claw 11 and the printing drum 2 is rotated in synchronism with the press drum 10. At the predetermined timing, the squeegee roller 8 is lowered and presses the screen member 7 outwardly. The screen member 7 and the stencil sheet 19, which are deformed outwardly, sandwich the print sheet 13 between the press drum 10 and the screen member 7 as well as the stencil sheet 19. The print sheet 13 is carried by being sandwiched between the deformed printing drum 2 and the press drum 10. While the print sheet 13 is being carried, ink supplied to the inner circumferential face of the screen member 7 is transcribed onto the print sheet 13 after passing through the screen member 7 and the stencil sheet 19 to thereby form an image.

Therefore, operation and effect similar to those in the above-described embodiments can be achieved also in this example.

Further, in this example, the first pinch rollers 65*a* press the outer circumferential surface of the press drum 10. At the same time, the second pinch rollers 65*b* press the outer circumferential surface of the discharge roll 61. But, the second pinch rollers 65*b* may press the outer circumferential surface of the discharge roll 61 after the first pinch rollers 65*a* press the outer circumferential surface of the press drum 10.

Further, control of the pinch roller pairs in operation of the example is the same as the control in the above-described embodiments and accordingly, an explanation thereof will be omitted.

According to the present invention, in a stencil printing machine having a printing drum, a press drum and pinch rollers, the pinch rollers are made movable to release positions separated from the press drum and adjustment of positions of the pinch rollers in the axial direction in correspondence with sheet width, is carried out when the pinch rollers are disposed at the release positions at other than printing operation.

Therefore, according to the present invention, the adjustment of the positions of the pinch rollers can be carried out without rotating the press drum and accordingly, there is achieved an effect in which the first print time is shortened.

What is claimed is:

1. A rotary type stencil printing machine comprising:

a printing drum on which perforated stencil sheet is made to wrap and which is rotated;

a press drum arranged at a vicinity of the printing drum and rotated in a direction reverse to a direction of the printing drum;

pinch rollers rotatably provided at a vicinity of the press drum for pressing a print sheet to the press drum such that the print sheet which has been sandwiched between the printing drum and the press drum and printed is held and carried by the press drum;

pinch roller position adjusting means for adjusting positions of the pinch rollers in an axis line direction such that the pinch rollers can be brought into contact with predetermined positions of the print sheet;

pinch roller releasing means for moving the pinch rollers between pinch positions at which the pinch rollers are brought into contact with the press drum and release positions at which the pinch rollers are separated from the press drum; and controlling means for controlling the pinch roller position adjusting means and the pinch roller releasing means such that the positions of the pinch rollers in the axis line direction can be adjusted only when the pinch rollers are set to the positions separated from the press drum.

2. The rotary type stencil printing machine according to claim 1, further comprising:

a sheet width sensor for detecting a width of the print sheet;

wherein the pinch rollers are two pieces of pinch rollers for pressing two edge portions of the print sheet in a width direction to the press drum;

wherein the pinch roller position adjusting means comprising:

a pair of moving members made movable in the width direction of the print sheet and attached with the pinch rollers;

moving means for moving the pair of moving members in directions reverse to each other; and a movement detecting sensor for detecting positions of the moving members;

wherein the pinch roller releasing means comprising:

attaching means for attaching the pinch rollers pivotably to the moving members;

driving means for setting the pinch rollers to the release positions or the pinch positions by pivotably moving the pinch rollers relative to the moving members; and a release detecting sensor for detecting whether the pinch rollers are brought into a release state; and wherein the controlling means sets the pinch rollers to the release positions by operating the driving means of the pinch roller releasing means after finishing a printing operation and controls the pinch roller position adjusting means in accordance with a signal from the sheet width sensor before carrying out the printing operation.

3. The rotary type stencil printing machine according to claim 2:

wherein the pinch roller releasing means further comprising:

cams which are connected to the driving means and pivoting: and an operating plate which is provided to be brought into contact with the cams and pivoted by pivoting the cams and one end portion of which is engaged with the attaching means:

wherein the pinch rollers are moved by the driving means, the cams, the operating plate and the attaching means.

4. The rotary type stencil printing machine according to claim 2:

wherein the pinch roller releasing means further comprising:

cams which are connected to the driving means and pivoting;

an operating plate which is provided to be brought into contact with the cams and pivoted by pivoting the cams and one end portion of which is engaged with the attaching means;

returning means for urging the operating plate in a release direction; and an elastic member having one end portion locked to the attaching means and the other end portion pressed by the operating plate when the operating plate is moved in a pinch direction reverse to the release direction;

wherein when the cams move the operating plate in the pinch direction against the returning means, the operating plate moves the attaching means in the pinch direction via the elastic member and sets the pinch rollers to the pinch positions; and wherein when the cams permit the operating plate to move in the release direction by the returning means, the operating plate moves the attaching means in the release direction and sets the pinch rollers at the release positions.

5. A rotary type stencil printing machine comprising:

a printing drum on which perforated stencil sheet is made to wrap and which is rotated;

a press drum arranged at a vicinity of the printing drum and rotated in a direction reverse to a direction of the printing drum;

a paper discharge roll arranged at a vicinity of the press drum and rotated in a direction the same as the direction of the press drum;

pinch roller pairs provided respectively rotatably at vicinities of the press drum and the paper discharge roll for pressing print sheet to the press drum and the paper discharge roll such that the print sheet which has been sandwiched between the printing drum and the press drum and printed is held and carried by the press drum and the paper discharge roll;

pinch roller position adjusting means for adjusting positions of the pinch roller pairs in an axis line direction such that the pinch roller pairs can be brought into contact with predetermined positions of the print sheet;

pinch roller releasing means for moving the pinch roller pairs between pinch positions at which the pinch roller pairs are brought into contact with the press drum and the paper discharge roll and release positions at which the pinch roller pairs are separated from the press drum and the paper discharge roll; and controlling means for controlling the pinch roller position adjusting means and the pinch roller releasing means such that the positions of the pinch rollers in the axis line direction are adjusted only when the pinch roller pairs are set to the positions separated from the press drum and the paper discharge roll.

6. The rotary type stencil printing machine according to claim 5, further comprising:

a sheet width sensor for detecting a width of the supplied print sheet:

wherein the pinch roller pairs are two sets of pinch roller pairs for pressing two edge portions of the print sheet in a width direction to the press drum;

wherein the pinch roller position adjusting means comprising:

a pair of moving members made movable in the width direction of the print sheet and respectively attached with the two sets of pinch roller pairs;

moving means for moving the pair of moving members in directions reverse to each other; and a movement detecting sensor for detecting positions of the moving members;

wherein the pinch roller releasing means comprising:

driving means for setting the pinch roller pairs to the release positions or the pinch positions;

cams driven to rotate by the driving means;

an operating member provided to be brought into contact with the cams, slidably moved by pivoting of the cams and provided with the pair of moving members via the moving means; and a release detecting sensor for detecting whether the pinch roller pairs are brought into a release state; and wherein the controlling means sets the pinch roller pairs to the release positions by operating the driving means of the pinch roller releasing means after finishing a printing operation and controls the pinch roller position adjusting means in accordance with a signal from the sheet width sensor before carrying out the printing operation.

* * * * *